United States Patent [19]

Koponen et al.

[11] 4,384,666

[45] May 24, 1983

[54] NOZZLE APPARATUS FOR HANDLING WEB MATERIAL

[75] Inventors: Vesa Koponen; Yngve Lindström, both of Turku, Finland

[73] Assignee: Valmet OY, Finland

[21] Appl. No.: 246,261

[22] Filed: Mar. 23, 1981

[30] Foreign Application Priority Data

Mar. 28, 1980 [FI] Finland ..... 800989

[51] Int. Cl.[3] ..... B65H 17/32

[52] U.S. Cl. ..... 226/97; 34/156

[58] Field of Search ..... 226/97; 34/156

[56] References Cited

U.S. PATENT DOCUMENTS

| | | | |
|---|---|---|---|
| 3,452,447 | 7/1969 | Gardner | 34/156 |
| 3,549,070 | 12/1970 | Frost et al. | 226/97 |
| 3,763,571 | 10/1973 | Vits | 226/97 X |
| 3,807,056 | 4/1974 | Norfolk | 226/97 X |
| 3,873,013 | 3/1975 | Stibbe | 226/97 |
| 4,137,644 | 2/1979 | Karlsson | 226/97 X |
| 4,197,971 | 4/1980 | Stibbe | 226/97 |
| 4,197,973 | 4/1980 | Daane | 226/97 |
| 4,201,323 | 5/1980 | Stibbe et al. | 226/97 |
| 4,247,993 | 2/1981 | Lindstrom | 226/97 X |
| 4,265,384 | 5/1981 | Daane | 226/97 |

*Primary Examiner*—Stanley N. Gilreath

*Attorney, Agent, or Firm*—Steinberg & Raskin

[57] ABSTRACT

Nozzle apparatus of the over-pressure type for handling web material includes a nozzle box having a nozzle carrying surface which is curved towards the interior of the box to define a recess in the direction of web run and a pair of opposed nozzle slots located so that gas jets issuing therefrom follow the nozzle carrying surface in opposite directions with respect to each other so as to meet in the region of the curved recess to form a tranquilization zone. In this manner an air cushion is formed for the web which extends over a considerable distance in the direction of the web run to carry the web.

6 Claims, 2 Drawing Figures

NOZZLE APPARATUS FOR HANDLING WEB MATERIAL

BACKGROUND OF THE INVENTION

The present invention relates generally to over-pressure nozzle apparatus for handling web material and, more particularly, to nozzle apparatus which includes a nozzle box and two opposed nozzle slots formed at the upper ends of respective compartments defined by inner and outer walls of the nozzle box.

The nozzle apparatus of the present invention supports and handles the web without contacting the same such, for example, as in connection with drying, heating, or cooling continuous webs.

For example, apparatus are employed in connection with the manufacture and refining of paper which utilize gas jets. In such devices, the gas is directed by several nozzles against one or both sides of the paper web, whereupon the gas is drawn off the web for reuse or disposal.

Several types of devices are known for handling web material in a non-contacting manner. Such known devices generally comprise a set of nozzles from which a gas flow is directed at the web in order to support and dry the same. Such known nozzle devices can be classified into two categories, namely over-pressure nozzles and under-pressure or vacuum nozzles. The operation of the over-pressure nozzle apparatus is based on an air-cushion principle whereas under-pressure or vacuum nozzle apparatus operate to draw the web toward them to thereby stabilize the web run. In such vacuum nozzle apparatus, the attractive force to which the web is subjected is due to a gas flow field which is directed substantially parallel to the web and which produces a static vacuum or under-pressure between the web and the carrying surface of the nozzle.

The so-called Coanda phenomenon is utilized in connection with both over-pressure and vacuum nozzles for directing the air in a desired direction.

In conventional vacuum nozzles the force to which the web is subjected is relatively low resulting in the fact that such nozzles cannot be used for handling heavy webs or in situations where the web tension is low. For this reason, vacuum nozzles are usually used in equipment shorter than 5 meters in length and which are provided with guide rolls on both sides for supporting the web.

On the other hand, over-pressure nozzles generally apply a relatively large force against the web. For this reason, it is possible to handle relatively heavy webs utilizing over-pressure nozzles as well as webs which are not subject to any tension.

However, conventional over-pressure nozzles are not entirely satisfactory in that relatively sharp gas jets are generally directed against the web substantially at right angles thereto resulting in an uneven distribution of the thermal transfer coefficient in the longitudinal direction of the web which gives rise to a decrease in the quality of the web being handled.

Another disadvantage of conventional over-pressure nozzles is that the gas jet issuing from the nozzle is somewhat unstable. Thus, it is possible for the direction of the gas jet issuing from the nozzle to turn from the nozzle opening directly into the suction region such, for example, due to the run of the web. This will result in a decrease in the thermal transfer coefficient and an unstability in the web run.

Reference is made to U.S. Pat. No. 3,549,070 and SE Patent Publications Nos. 341,870 and 352,121 with respect to the state of the art. Nozzle apparatus are disclosed in these publications wherein gas jets are caused to turn to a direction parallel to the web run utilizing the Coanda phenomenon. Since the gas jets issue from the nozzles substantially perpendicularly to the web, the jets have insufficient time to take the direction of the running web prior to their separation from the guide surface of the nozzle. In this connection, it has been shown that a jet discharged from a nozzle will follow a curved surface through an angle of about 45° to 70° without becoming separated from the surface but that an angle 70° cannot be exceeded. This fact is clearly proven in D. W. McGlaughine's and I. Greber's "Experiments of the Separation of a Fluid Jet from a Curved Surface" published by the American Society of Mechanical Engineers, Advances in Fluids, 1976. Accordingly, the gas jet will separate from the curved guide surface before it obtains the direction of the web and will impinge upon the web causing a localized peak for the thermal transfer coefficient at the point of impingement. The gas jet can then be drawn into the suction space located between the nozzle slots of a nozzle thereby leaving the so-called "carrying surface" of the nozzle without any gas cushion and with a thermal transfer coefficient being practically negligible in this region.

Furthermore, the gas jet separating from the nozzle surface is unstable and may become misdirected such, for example, as under the influence of the running web, without ever impinging upon the web being handled. In such case, the gas jet never contacts the web thereby resulting in a reduction in the thermal transfer between the gas jet and the web. This phenomenon is described in the above-mentioned U.S. Pat. No. 3,549,070. Such a flow pattern is detrimental not only in that the thermal transfer coefficient is reduced but, additionally, the run of the web is disturbed to a point wherein it is possible for the web to contact the surface of the nozzle thereby further reducing the quality of the finished product.

Another arrangement for a nozzle is disclosed in U.S. Pat. No. 3,452,447. The Coanda phenomenon is not utilized to control the gas jet in the nozzle arrangement disclosed therein but, rather, the nozzle slot is so constructed that the directional control of the gas jet is completed as it is discharged through the nozzle slot. In view of the large component of the gas jet perpendicular to the web and the over-pressure that prevails in the area between the nozzle slot, a nozzle constructed in accordance with this patent functions in the same way as the conventional nozzles described above which can easily be confirmed by heat transfer measurements.

SUMMARY OF THE INVENTION

Accordingly, it is the object of the present invention to provide new and improved over-pressure nozzle apparatus wherein the drawbacks mentioned above are eliminated.

Briefly, in accordance with the present invention, this object, among others, is attained by providing nozzle apparatus wherein nozzle slots are located with respect to a nozzle carrying surface in a manner such that the gas jets issuing therefrom follow the carrying surface without separating therefrom and wherein the carrying surface has a curved configuration defining a recess which functions as a tranquilization zone. The tranquilization zone so formed is located between opposed nozzle slots and the gas jets follow the nozzle carrying surface in opposite directions with respect to each other and meet in the region of the recess or tranquilization zone to form an air cushion that extends over a substantial distance in the direction of the web run so as to form a gas cushion for the web.

Nozzle apparatus constructed according to the present invention eliminates the problems associated with the conventional nozzle structure described above, namely the improper direction of the gas jets and significant reduction of thermal transfer coefficient. In this connection, the nozzle slots are located on respective curved nozzle guide surfaces so that the gas jets issuing therefrom follow the nozzle carrying surface without separating therefrom. The nozzle carrying surface has a curved configuration so as to define a recess or so-called tranquilization zone, into which the gas jets flow in opposite directions and meet to form an air cushion which extends over a relatively long distance in the direction of the web run to carry the web.

By the particular construction described above, the thermal transfer coefficient in the region between the nozzle slots is relatively high. Further, since the web is not subjected to any sharp or localized gas jets and since the possibility of the gas jets being improperly directed is prevented due to the fact that the gas jets do not separate from the nozzle carrying surface, the web treatment will be even and substantially stable.

DESCRIPTION OF THE DRAWINGS

A more complete appreciation of the present invention and many of the attendant advantages thereof will be readily appreciated as the same becomes better understood by reference to the following detailed description when considered in connection with the accompanying drawings in which.

DESCRIPTION OF THE PREFERRED EMBODIMENTS

Figure 1:
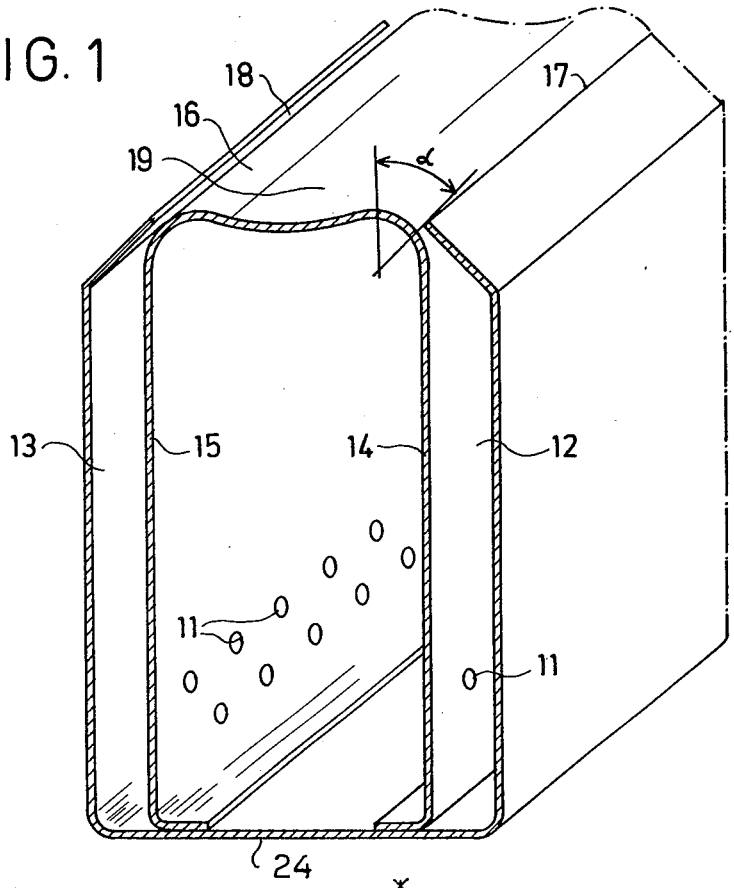
FIG. 1 is a perspective view of nozzle apparatus according to the present invention.

Referring now to the drawing wherein like reference characters designate identical or corresponding parts throughout the several views, the nozzle apparatus comprises an inner nozzle wall defining a nozzle carrying surface 16, a pair of parallel inner side wall portions 14 and 15 and a pair of curved guide wall portions, each interconnecting a respective inner side wall portion and the nozzle carrying surface 16. An outer nozzle wall defines a nozzle bottom wall portion 24, a pair of substantially parallel outer side wall portions 20 and 21 and a pair of substantially planar nozzle wall portions 22 and 23 extending from the ends of respective ones of the outer side wall portions 20 and 21, respectively.

Gas, such as air, is directed under pressure from the interior 10 of the nozzle box through openings 11 formed in the inner side wall portions 14 and 15 into side compartments 12 and 13 defined by respective pairs of inner and outer side wall portions 15, 20 and 14, 21.

As noted above, the inner side wall portions 14 and 15 are curved towards each other at their upper ends to define the pair of curved guide wall portions, the latter preferably being in the form of arcs of a circle having a radius of curvature $R_1$.

The carrying surface 16 is curved inwardly in the form of an arc of another circle having a radius of curvature $R_2$. In this manner, the nozzle carrying surface 16 is formed over which web W runs in a direction B at a distance $\Delta$ from the uppermost point thereof.

Figure 2:
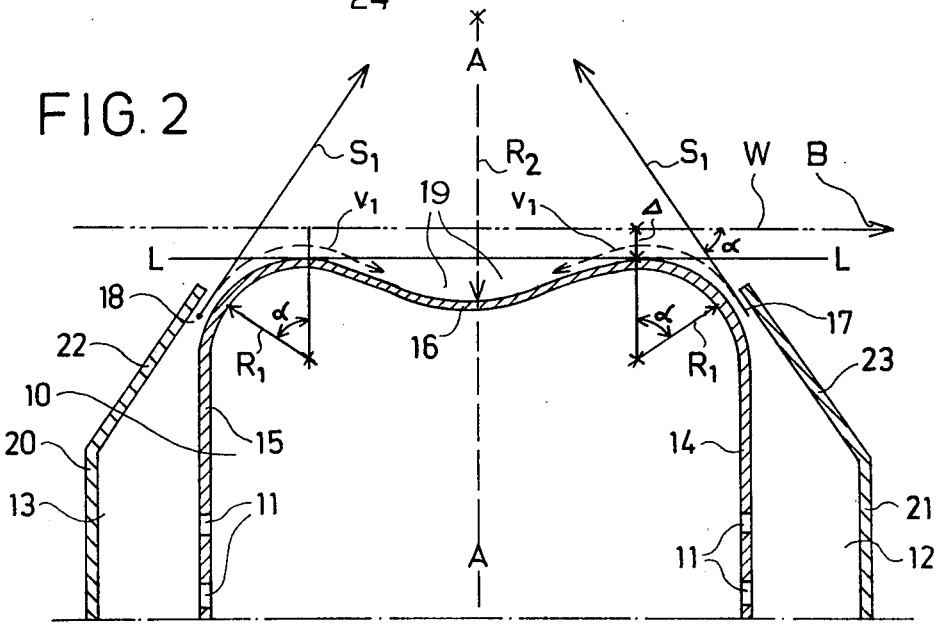
FIG. 2 is a detailed view of the upper parts of the nozzle apparatus illustrated in FIG. 1 illustrating the geometry thereof.

The planar nozzle wall portions 22 and 23 of the outer nozzle wall are directed towards each other so as to define together with respective ones of the curve guide wall portions (having the radius $R_1$) nozzle slots 17 and 18. The mouths of the nozzle slots 17 and 18 are preferably located on respective ones of the curved guide surfaces defined by the curved guide wall portions at an angle $\alpha$. As seen in FIG. 2, angle $\alpha$ constitutes the angle between the initial or discharge direction $S_1$ of the gas jet issuing from the nozzle slots 17 and 18 and the plane of web W. At the same time, angle $\alpha$ constitutes the angle of the arc over which the gas jet travels over the curved guide surfaces from the mouth of the nozzle slots 17 and 18 to the level L—L.

The imaginary plane L—L defines between it and the curved nozzle carrying surface 16 a recess 19 that functions as a tranquilization zone in accordance with the present invention. More particularly, gas jets $V_1$ issuing from the nozzle slots 17 and 18 follow the curved guide surfaces which merge into the nozzle carrying surface 16 without separating therefrom and flow in opposite directions with respect to each other and meet in the tranquilization zone 19 to form an air cushion which extends over a substantial distance in the direction of the web run so as to carry the web.

The radius of curvature $R_2$ of recess 19 is preferably substantially larger than the radii of curvature $R_1$ of the curved guide wall positions.

An essential feature of the present invention is that the angle $\alpha$ is so selected as to prevent the flows $V_1$ of the gas jets from separating from the curved nozzle carrying surface 16 before the jets $V_1$ assume a direction parallel to the run of web W. In this manner, the jets $V_1$ flow toward each other and meet in the area of recess 19 above the carrying surface 16 whereby a relatively large air cushion for supporting and carrying the web W is formed. It will be appreciated that the gas flow in the recess 19 will be turbulent and due to such turbulence, the thermal transfer coefficient is maintained at an adequate value in the area between the nozzle slots 17 and 18.

In accordance with the invention, the angle $\alpha$ associated with the nozzle guide surfaces should not exceed about 70° and preferably be in the range of about 40° to 60°.

A central vertical plane A—A is illustrated in FIG. 2 which passes perpendicularly through the innermost point of recess 16. Preferably, the construction of the over-pressure nozzle apparatus according to the invention is such that the same is symmetrical with respect to such central plane A—A. However, it is understood that the present invention can be constructed so as to be unsymmetrical with respect to plane A—A.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. In nozzle apparatus for handling and/or treating webs, including a nozzle box having a pair of opposed nozzle slots located at the upper regions of respective spaces defined by respective inner and outer side wall portions of the nozzle box, the improvement comprising:

said nozzle box includes a carrying surface defining a pair of opposed curved guide surfaces which merge at their respective ends with a carrying surface portion situated between said pair of curved guide surfaces which curves toward the interior of the nozzle box in the shape of a continuous and smooth arc to define a recess below the uppermost points of said curved guide surfaces; and wherein each of said pair of nozzle slots has a nozzle mouth located on a respective one of said curved guide surfaces from which a gas jet issues from said nozzle slot onto said respective one of said curved guide surfaces; and wherein said nozzle slot mouths are each located such that the initial direction of the gas jets issuing therefrom forms an angle with the direction of web run which does not exceed about 70° so that the gas jets follow said curved guide surfaces of said carrying surface without separating therefrom up to said recess formed between said nozzle slots; and wherein said recess is dimensioned to act as a tranquilization zone where the gas jets flowing in opposite directions meet to form a gas cushion for supporting the web, said cushion extending over a considerable distance in the direction of travel of the web.

2. The combination of claim 1 wherein the angle defined between the plane of the mouth of each nozzle slot and the plane passing through the uppermost points of said curved guide surfaces is the same as the angle formed by the initial direction of the gas jets issuing from the nozzle slot mouths and the direction of the web run and does not exceed about 70°.

3. The combination of claim 1 wherein said angle is in the range of between about 40° to 60°.

4. The combination of claim 1 wherein said recess formed on said nozzle carrying surface comprises an arc of a circle and said curved guide surfaces comprise arcs of a circle.

5. The combination of claim 4 wherein the radius of curvature of said recess formed in said nozzle carrying surface is substantially longer than the radius of curvature of the curved nozzle guide surfaces.

6. The combination of claim 1 wherein said nozzle apparatus is substantially symmetrical with respect to a central plane passing through said nozzle box perpendicularly to said nozzle carrying surface.

* * * * *